United States Patent [19]

Pelton

[11] Patent Number: 4,717,126

[45] Date of Patent: Jan. 5, 1988

[54] APPARATUS FOR HOLDING AND REFINING OF MOLTEN ALUMINUM

[75] Inventor: John F. Pelton, Yorktown Heights, N.Y.

[73] Assignee: Union Carbide Corporation, Danbury, Conn.

[21] Appl. No.: 834,922

[22] Filed: Feb. 28, 1986

[51] Int. Cl.[4] ..... C22B 4/08

[52] U.S. Cl. ..... 266/200; 266/242; 266/280; 266/900; 373/137

[58] Field of Search ..... 266/200, 235, 900, 901, 266/280, 242, 275; 373/137

[56] References Cited

U.S. PATENT DOCUMENTS

| | | | |
|---|---|---|---|
| 1,439,410 | 12/1922 | Gray | 266/280 |
| 3,724,447 | 4/1973 | Parkhill et al. | 266/200 |
| 3,942,293 | 3/1976 | Cook | 266/280 |
| 4,040,610 | 9/1977 | Szekely | 266/235 |
| 4,203,581 | 5/1980 | Pelton | 266/235 |

*Primary Examiner*—L. Dewayne Rutledge
*Assistant Examiner*—S. Kastler
*Attorney, Agent, or Firm*—A. H. Fritschler

[57] ABSTRACT

A support plate is used, together with the shell of a vessel for the holding and/or refining of aluminum, in combination with a refractory sheet and a metal heating element container positioned in a graphite block to protect said heating element and to thus extend the life of said heating element. Oxidation of the graphite block is precluded, as is the attack upon the heating element by chlorides passing through the pores of said graphite block.

10 Claims, 1 Drawing Figure

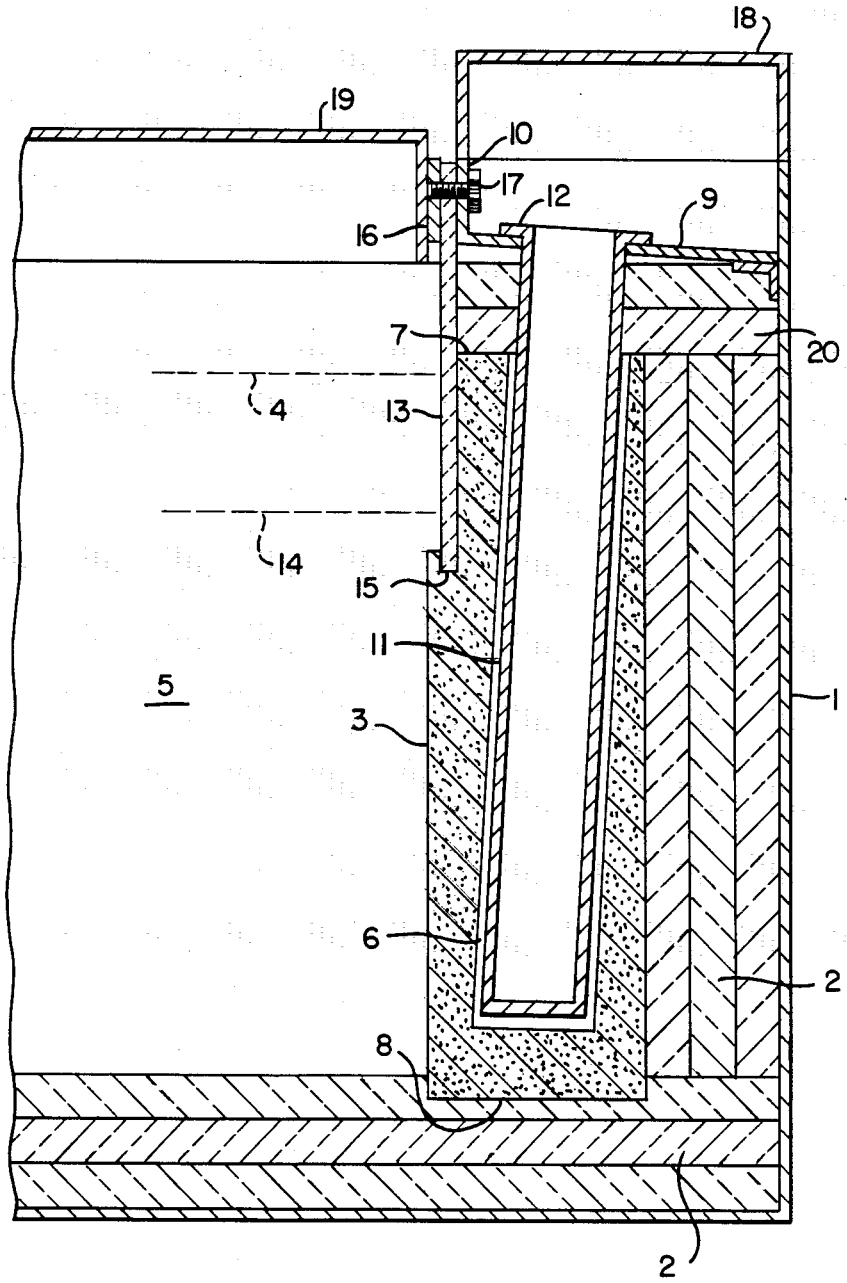
18
19
10
17
12
9
16
7
20
4
13
14
15
11
5
1
3
6
2
8
2

APPARATUS FOR HOLDING AND REFINING OF MOLTEN ALUMINUM

BACKGROUND OF THE INVENTION

1. Field of the Invention

This invention relates to apparatus for the holding of molten aluminum. More particularly, it relates to the protection of the heating elements used in such apparatus.

2. Description of the Prior Art

In the refining of aluminum, the use of externally heated, refractory lined cast iron tubs as the refining vessels has been found to be disadvantaged by the limited and somewhat unpredictable life of said tubs. This undesired condition results from the failure of the cast iron tubs because of cracking, bulging, chloride corrosion or wash-out. In addition, design constraints pertaining to such cast iron tubs result in the use of configurations that are difficult to clean, creating a further practical disadvantage to their use in commercial operations.

In an effort to overcome such disadvantages, a refining system was devised consisting of a refractory lined vessel having vertical tubular immersion heaters, such as silicon carbide tubes with internal helical resistance heating elements, suspended from the refining vessel cover. In this case, the heaters were found to have a limited life and, in practice, were very hard to replace. When a heater failed because of the breakage of the silicon carbide tube, pieces of the broken tube would frequently cause breakage of the spinning nozzle used to inject gas into the molten aluminum within the vessel. In addition, such a system was very difficult to clean because of the many recesses between adjacent heater tubes, and between the heater tubes and the vessel walls, where dross would accumulate and be difficult to remove in a convenient manner.

As a result of such problems, an improved apparatus was developed for the refining of aluminum or other molten metals. This apparatus comprised an all-refractory system in which two opposite side walls each consisted of a graphite block having electrical heating elements positioned in vertical holes provided in the graphite blocks, said holes being open at the top and closed at the bottom thereof. Various other features of this system are disclosed in the Szekely patent, U.S. Pat. No. 4,040,610. This system thus provided an internal heating source while overcoming the drawbacks associated with the use of the immersion heater. It was found to increase heater life, minimize erosion and facilitate repair of the system. For the holding of aluminum in the molten state, such as system comprised a vessel adapted for the holding of aluminum in a molten state and including an insulated shell impervious to molten metal, a lining comprising graphite blocks for a portion of the interior of the shell that is intended to be below the surface of melt, and at least one heating means disposed within one or more of the blocks. For application in the refining of aluminum, the system also included at least one rotating gas distributing means disposed in the vessel, as well as inlet and outlet means for molten metal and for gases.

Refractory systems using such graphite heater blocks have been found to constitute a desirable improvement in the art and have been employed to advantage in commercial aluminum refining operations. Nevertheless, further improvements in such systems are desirable to enhance their suitability by the overcoming of practical operating problems encountered in commercial operations. The main problem thus encountered relates to the relatively short life of the heaters under commonly employed operating conditions. One mode of such failure results from oxidation of the graphite heater block, usually from the top portion thereof. Upon oxidation of the block from the top portion and then downward to below the operating metal level in the refining or holding vessel, molten aluminum is able to flow through the oxidized block into the heater cavity, thereby shorting out the electrical heating element positioned therein. Furthermore, where chlorine is employed in the process gas employed, liquid chlorides formed in the molten aluminum may pass through the graphite block and accumulate in the bottom of the heater cavity, leading to the shorting out of said electrical heating element positioned therein. In addition, corrosion of the heaters and heater connections is found to occur as a result of the passage of liquid or vapor state chlorides, that are generated during the refining of aluminum, from the refining chamber, through the interconnected porosity of the graphite block, and into the heater zone in said graphite block. The overcoming of such causes of the relatively short life of the heaters would constitute a significant advance in the development of aluminum holding and refining vessels.

It is an object of the invention, therefore, to provide an improved electrically heated apparatus for the holding and refining of aluminum.

It is another object of the invention to provide a vessel for the holding and refining of aluminum in which the life of the electrical heating elements positioned within a graphite block is desirably extended.

It is a further object of the invention to provide an aluminum holding or refining vessel in which the graphite block in which an electrical heating element is positioned is protected from oxidation and said heating element is protected from chloride attack.

With these and other objects in mind, the invention is hereinafter described in detail, the novel features thereof being particularly pointed out in the appended claims.

SUMMARY OF THE INVENTION

The invention combines the positioning of a refractory sheet on the inner surface of the graphite block above the level of aluminum melt within the vessel, with the use of a support plate attached to the shell of the vessel above the graphite block and a metal heating element container positioned within the graphite block. By the interrelated combination of such elements, the oxidation of the block and the attack of chlorides on the heating element positioned in the block can be effectively prevented.

BRIEF DESCRIPTION OF THE DRAWING

The invention is hereinafter described with reference to the accompanying drawing in which the sole figure is a schematic diagram in detail of a cross section of the subject apparatus of the invention.

DETAILED DESCRIPTION OF THE INVENTION

The objects of the invention are accomplished by the recited interrelated combination of elements serving to protect against the oxidation of the graphite block from the side or the top thereof, and to preclude the attack upon the electrical heating elements by the passage of chlorides through the pores of the graphite block. In the improved vessel of the invention therefore, a significant problem detracting from the desirable benefits of the placing of heaters within the graphite block is successfully overcome.

It will be appreciated that the invention relates to a vessel for the holding of molten aluminum, with or without the refining of said aluminum, with the vessel having an insulated shell having a bottom and side walls impervious to molten aluminum, and incorporating a graphite block lining on at least one interior side wall of the shell. The graphite block extends above the design operating melt level within the vessel and is positioned so as to come into contact with the molten aluminum within the vessel. The block has an opening therein extending from the upper end thereof in the direction of, but not reaching, the bottom of the block. An electrical heating element, i.e., an electric resistance heating element, is disposed within the opening in the graphite block, with the heating element being supported in said opening without electrical contact with the graphite block. It is such a vessel and structure that, in the prior practice discussed above, is generally satisfactory except for the relatively short life of the heaters under operating conditions encountered in commercial practice.

With reference to the drawing, the combination of elements employed to enhance heater life will be seen as pertaining to the interrelated protection of the heating element from chloride attack and the protection of the graphite block from oxidation. The furnace shell is represented by the numeral 1, affixed to which is a conventional refractory insulation 2 on the bottom and side walls, said insulation being impervious to molten aluminum. On at least one interior side wall of the thus insulated shell, graphite block 3 is positioned to extend above the design operating melt level 4 within the vessel, said graphite block 3 being positioned to come into contact with the body of molten aluminum 5 maintained within the vessel during holding or refining operations. Graphite block 3 has an opening 6 therein extending from the upper end 7 thereof in the direction of, but not reaching, the bottom 8 of said block.

In the practice of the invention, a support plate means 9 is attached and sealed to shell 1 and extends inwardly into the vessel over graphite block 3 at a position above the upper end 7 of said block. In the preferred embodiment of the drawing, it will be seen that said support plate 9 has a flanged portion 10 at the innermost end thereof to facilitate the combination of said support plate 9 with other features of the invention. A metal heating element container 11 is positioned within opening 6 in said graphite block 3, it being appreciated that said container 11 extends above said graphite block and is secured and sealed to support plate 9. For this purpose, container 11 conveniently extends through an opening in said support plate 9, the container having a flanged portion 12 that is secured and sealed to the upper surface of said plate.

The invention also includes a refractory sheet 13 positioned on the inner surface of graphite block 3. This refractory sheet extends vertically so as to protect graphite block 3 from contact with oxygen in the gas phase above the level of melt, i.e., molten aluminum 5, within the vessel. For this purpose, the lower end of said refractory sheet 13 extends not only to below the design operating melt level 4, but further to below the design idle level 14 within the vessel. The lower end of refractory sheet 13 is shown as conveniently positioned within notch 15 in said graphite block 3. It will also be understood that said refractory sheet 13 extends horizontally substantially to both sides of the shell for purposes of totally protecting the graphite block.

At its upper end, refractory sheet 13 is shown positioned between, and secured to, said flange portion 10 of support plate 9 and plate 16 that constitutes a part of the overall shell 1 of the vessel. Bolt means 17 are conveniently employed for this purpose of securing refractory sheet 13 to support plate 9 and the vessel shell.

In a convenient embodiment of the invention, the vessel cover comprises an electrical cover 18 and a separate cover 19 over the body of molten aluminum in the vessel. Electrical cover 18 is shown as conveniently connected to said flange portion 10 of support plate 9 and to shell 1. Cover 19 is shown as conveniently connected and sealed to said shell plate 16. Those skilled in the art will appreciate that said cover 19 can also comprise a support for conventional gas distribution means, not shown, used for the introduction of gas with the molten aluminum during refining operations.

In combination, the elements of the invention provide a protection for the heater positioned in the graphite block opening such as to significantly extend the life of said heater and thus enhance the overall aluminum holding or refining vessel. It will be appreciated that the electrical heating elements used in the practice of the invention, and of the related prior art, are of conventional design and are readily available in the art as standard commercial products. Such heaters have not been shown, for convenience, but will be understood to be positioned within metal containers 11 and can readily be serviced by the convenient removal of separate electrical cover 18. Purge gas, such as air, can be passed through the space under said cover 18, if desired, to provide ventilation.

The positioning of the electrical heating elements within metal containers 11 will be seen to protect said heating elements from attack by liquid chlorides that may otherwise accumulate in the bottom of graphite block opening 6, and short out the heating element positioned therein, in operations in which chlorine is used as process gas. Metal container 11 will also be seen to protect said heating element and heater connections from corrosion by liquid or vapor state chlorides that may be generated during refining operations that can pass through the interconnected pores or porosity of the graphite, and thus might otherwise travel from the vessel chamber into the opening 6 for contact with the heater therein. By itself, however, metal heating element container 11, together with support plate 9 to which it is attached, cannot effectively achieve the extension of heater life desired in the art. It is the combination of said elements, and the shell of the vessel, with refractory sheet 13 that enables the objects of the invention to be accomplished in a commercially significant manner. As noted above, graphite block 3 in which the heater is positioned is subject to oxidation from the top and from the side down to the level of molten aluminum within the vessel. When the block is subjected to oxidation, the oxidized portion of the block is found, in practice, to enlarge and extend down to below the level of molten aluminum. When this occurs, molten aluminum will flow through the open spaces caused by the oxidation of the graphite and will attack and dissolve metal heating element container 11 and short out the heater positioned therein. Refractory sheet 13 protects the graphite block from oxidation by oxygen present in the gas phase above the level of molten aluminum in the vessel. To assure this result, said refractory sheet desirably extends horizontally across and downward, as noted above, to below the design idle level 14 within the vessel. It will be seen, therefore, that refractory sheet 13 effectively serves to protect the inner side of graphite block 3 from oxidation in the gas phase above the level of melt within the vessel. Undersired oxidation of the graphite block can nevertheless occur from the top 7 of the graphite block in the absence of the desirable combination of elements as employed in the practice of the invention.

In the illustrated embodiment of the invention, oxidation of the graphite block from the top is prevented, however, by the (1) attaching and sealing of support plate means 9 to shell 1, (2) attaching and sealing of flange portion 12 of metal container 11 to said support plate 9, and (3) securing of said refractory sheet 13 between flange portion 10 of support plate 9 and plate 16 forming part of the overall vessel shell. In this preferred embodiment of the invention, the graphite block 9 is protected from oxidation commencing at the top or on the inner side thereof, thereby precluding the undesired passage of molten aluminum through open spaces or holes created by the oxidation of graphite upon the extension of such undesired oxidation to the level of melt in the vessel. The invention thus enables all of the problems encountered in the desired graphite heater block approach to be overcome in a convenient and highly effective manner.

It will be appreciated by those skilled in the art that various changes and modifications can be made in the details of the invention without departing from the scope of the invention as set forth in the appended claims. Thus, it will be appreciated that more than one such graphite block 9 can be employed in any particular vessel, and more than one electrical heating element can be positioned in separate openings 6 in one or more such graphite blocks. It is also desirable to incorporate additional conventional insulation in the vessel, such as insulation 20 beneath support plate 9 and above graphite block 3, or elsewhere, as under cover 19.

It will be noted that opening 6 of graphite block is shown as being inclined downward in the direction of the inner surface of the block. This reflects a practical design consideration, whereby the heater can be positioned closer to the inner surface of the block in the region of the melt while enabling ample room at the upper end thereof for the securing of the metal heating element container to the support plate means. It is within the scope of the invention, however, to position the opening in the graphite block so that it extends downward essentially vertically or in any other orientation provided that the heater is able to adequately heat the molten aluminum in the vessel.

It will be appreciated that, for refining operations, the gas distribution means may comprise any such means known in the art and convenient for use in a given application. A rotating gas distribution means, such as the use of a shaft-driven rotating rotor is commonly employed for this purpose. As disclosed in said Szekely patent referred to above, such a rotating rotor commonly contains vertical vanes and a stator fixedly attached to a protective sleeve surrounding said shaft. Means are provided, of course, for introducing the gas into the space between said rotor and stator.

While any convenient materials of construction may be employed in the apparatus of the invention, it should be noted that the refractory sheet is desirably a ceramic fiber reinforced structural alumina available in sheet form convenient for use as herein disclosed and claimed. Such a sheet available commercially is ZIRCAR TM Refractory Sheet Type 100, having useful properties to 2400° F., marketed by Zircar Products, Inc. Such sheets, comprising about 75% alumina ($Al_2O_3$), 16% silica and 9% of the other metal oxides, have highly desirable flexural and compressive strengths in the range of high temperature reinforced plastics, but retain strength and utility to levels far exceeding the maximum use temperatures of common plastics. In addition, the mechanical properties of such sheets exceed those of commonly available asbestos—cement materials. Those skilled in the art will appreciate that various other materials either exist or may exist that have properties likewise making them highly resistant to molten aluminum and otherwise suitable for use in the practice of the invention.

For the sealing of the support plate to the shell, to prevent the passage of oxygen from above the support plate to the top portion of the graphite block, it is desirable to use a high temperature silicone sealant, such as the RTV sealant of Dow-Corning, or other such commercially available sealant composition. Such a sealant can also be used to seal the metal heating element container to the support plate if desired for added assurance against the passage of oxygen down the annular space between the side walls of the graphite opening and said metal heating element container.

The vessel shell and the support plate employed in the practice of the invention are commonly of steel construction. The metal heating element container is desirably made of stainless steel or other heat resistant alloy to limit oxidation scaling on the inside surface thereof and to resist distortion and cracking caused by high temperature thermal cycling. Those skilled in the art will appreciate, however, that such elements of the invention can be constructed of any other suitable materials, sheets or boards offering benefits of convenience, cost or size without departing from the scope of the invention as disclosed and claimed herein.

Advantageous features other than those related to the desired extension of the life of heaters have been found to pertain in the practice of the invention. Thus, by applying very good insulation to the vessel shell and cover, as well as over the graphite block in which the heater is positioned, the heat loss in the system can be reduced sufficiently to enable all of the necessary heat to be supplied from only one side wall of the vessel. This, in turn, enables the system to be designed for easy cleaning and dumping, if desired. It has also been found possible to install the bath control thermocouple in the refractory side wall, thus eliminating all internal obstructions except for the rotating gas distribution means itself.

The invention represents a significant advance in the development of apparatus for the holding and refining of aluminum. In the highly desirable use of graphite heater blocks, the invention overcomes a practical operating disadvantage encountered in the field, namely the short life of the heaters under various practical operating conditions. In overcoming this disadvantage, the invention enhances the highly desirable graphite heater block approach to aluminum holding and refining, rendering such approach more convenient, less costly and more desirable for use in practical commercial operations.

I claim:

1. In a vessel for the holding, with or without refining, of molten aluminum and comprising (1) an insulated shell having bottom and side walls impervious to molten aluminum; (2) graphite block lining on at least one interior side wall of said shell, said graphite block extending above the design operating melt level within the vessel, said graphite block being positioned so as to come into contact with the molten aluminum within the vessel, and having an opening therein extending from the upper end thereof in the direction of, but not reaching, the bottom of said block; (3) an electrical resistance heating element disposed within the opening in said graphite block, said heating element being supported therein without electrical contact with said graphite block, the improvement comprising:

(a) support plate means attached to said shell and extending inwardly into the vessel over the graphite block at a position above said graphite block;

(b) a metal heating element container positioned within said opening in the graphite block, said container extending upward above said graphite block and being secured and sealed to said support plate means;

(c) a refractory sheet positioned on the inner surface of said graphite block and extending vertically so as to protect said graphite block from contact with oxygen in the gas phase above the level of melt within the vessel, said refractory sheet extending horizontally substantially to both sides of the shell, the upper end of said refractory sheet being secured to said support plate to protect the top of said graphite block from contact with oxygen from said gas phase, thereby totally protecting said graphite block from oxidation, whereby said refractory sheet and support plate means, in conjunction with said shell and said metal heating element container, serve to preclude the oxidation of the graphite block from the side or top down to below the level of melt in the vessel, with subsequent flow of molten aluminum into the opening in said graphite block, said metal container serving to protect the heating element from attack by liquid or vapor state chlorides capable of passing through the interconnected pores of said graphite block.

2. The apparatus of claim 1 in which said metal container has a flanged portion at the upper end thereof, said flanged portion being secured to said support plate means.

3. The apparatus of claim 1 in which said refractory sheet is secured at its upper end between said support plate means and a metal plate comprising a portion of said shell, the lower end thereof extending below the lower design level of melt within said vessel.

4. The apparatus of claim 3 in which the lower end of said refractory sheet is positioned within a notch in said graphite block.

5. The apparatus of claim 3 and including the insulation means positioned between said support plate means and the upper end of said graphite block.

6. The apparatus of claim 3 in which said support plate means includes an upwardly extending flange portion at the inner end thereof, said flange portion and a metal plate comprising a portion of said shell being secured together with the upper end of said refractory sheet being positioned therebetween.

7. The apparatus of claim 6 and including an electrical connection cover positioned over said support plate means and secured to the refractory shell, and a separate melt space cover positioned over said melt space within the vessel.

8. The apparatus of claim 2 in which said flanged portion is sealed to said support plate means.

9. The apparatus of claim 7 and including gas distribution means for injecting gas into molten aluminum within said vessel.

10. The apparatus of claim 9 in which said gas distribution means comprises a shaft-driven rotating rotor containing vertical vanes and a stator fixedly attached to a protective sleeve surrounding said shaft, and including means for introducing gas into said gas distribution means for passage into the space between said rotor and stator.

* * * * *